US008475301B1

(12) United States Patent
Lane

(10) Patent No.: US 8,475,301 B1
(45) Date of Patent: Jul. 2, 2013

(54) PORTABLE MULTI-FUNCTIONAL GAMING ASSEMBLY AND ASSOCIATED METHOD

(76) Inventor: Patrick B. Lane, San Antonio, TX (US)

( * ) Notice: Subject to any disclaimer, the term of this patent is extended or adjusted under 35 U.S.C. 154(b) by 253 days.

(21) Appl. No.: 12/856,634

(22) Filed: Aug. 14, 2010

Related U.S. Application Data

(60) Provisional application No. 61/234,053, filed on Aug. 14, 2009.

(51) Int. Cl.
*A63B 67/00* (2006.01)
*A63B 71/02* (2006.01)
*A63B 61/00* (2006.01)

(52) U.S. Cl.
USPC ..... 473/416; 473/492; 473/479; 473/459

(58) Field of Classification Search
USPC ..... 473/416, 433, 447, 473, 474, 476, 473/479, 485, 487, 492–494
See application file for complete search history.

(56) References Cited

U.S. PATENT DOCUMENTS 3,602,504 A * 8/1971 Chapman et al. ..... 473/416
4,786,053 A * 11/1988 Barnes, Jr. ..... 473/416
5,072,947 A * 12/1991 Blue ..... 273/371
5,730,668 A * 3/1998 Hege et al. ..... 473/472
5,800,291 A * 9/1998 Grover ..... 473/447
6,348,028 B1 * 2/2002 Cragg ..... 482/148
7,001,291 B2 * 2/2006 Carey ..... 473/481

* cited by examiner

*Primary Examiner* — Nini Legesse

(57) ABSTRACT

A multi-functional gaming assembly may include a portable free-standing first section capable of being selectively modified into a baseball batting game, a basketball shooting game, and a tether-ball swinging game assembly respectively. A portable free-standing second section may be removably connected to the portable free-standing first section in such a manner that the portable free-standing first and second sections may cooperate to selectively include a tennis playing game, a badminton playing game, and a volleyball playing game. A plurality of anchor stakes may be removably attached to the portable free-standing first and second sections respectively. The portable free-standing first section may include a mobile primary base which may include a wire frame preferably having a handle and a plurality of rings extending out from a perimeter of the wire frame. The portable free-standing second section may include a mobile auxiliary base spaced apart from the mobile primary base.

16 Claims, 13 Drawing Sheets

10
55
53
66
23
50
52
51
51
22
49
23

38
42
43
36
37
35
21
29
24
23

60
40
39
34
35

PORTABLE MULTI-FUNCTIONAL GAMING ASSEMBLY AND ASSOCIATED METHOD

CROSS REFERENCE TO RELATED APPLICATIONS

This application claims the benefit of U.S. Provisional Application No. 61/234,053, filed Aug. 14, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to sports gaming equipment and, more particularly, to a multi-functional gaming assembly having modular components that enable a user to simultaneously construct a variety of different games that can be played at the same time.

2. Prior Art

Traditionally fixed poles or other stationary structures are required to hold a sports net for games such as tennis, basketball and the like. These structures must be positioned in a suitably rigid position during game play. The impact of the ball when struck on a net requires that such net poles be mainly set in concrete permanently. The effect of strong winds and even the tailwind caused by, for example super fast tennis balls may cause a net if not suitably secured to crumble and ruin a shot or even end the game. In all cases permanent games courts use fixed installations which are expensive and inflexible as some of these courts may have the possibility of playing different games at different times or seasons. Conventional portable game poles such as the backboards for basketball are usually bulky, large and heavy and cannot be transported over long distances.

Additionally, most portable game nets are usually designed for a single type of game and therefore several different sets of equipment can be found in most sports facilities. The cost and space required for a few of these sets of equipment would be very high and added to the maintenance cost and tedious efforts in setting up different equipment may discourage sports halls and individuals in private homes to engage in the many courts games that can be played at home or located at a convenient location.

Accordingly, a need remains for a system in order to overcome the above-noted shortcomings. The present invention satisfies such a need by providing a portable multifunctional sports net assembly that is convenient and easy to use, lightweight yet durable in design, versatile in its applications, and designed for providing a user with means to easily construct a sports net for playing various court games in different locations.

BRIEF SUMMARY OF THE INVENTION

In view of the foregoing background, it is therefore an object of the present invention to provide an apparatus for allowing a player to participate in a variety of alternate games.

These and other objects, features, and advantages of the invention are provided by a multi-functional gaming assembly.

The multi-functional gaming assembly may include a portable free-standing first section capable of being selectively modified into a baseball batting game, a basketball shooting game, and a tether-ball swinging game assembly respectively. A portable free-standing second section may be removably connected to the portable free-standing first section in such a manner that the portable free-standing first and second sections may cooperate to selectively include a tennis playing game, a badminton playing game, and a volleyball playing game. A plurality of anchor stakes may be removably attached to the portable free-standing first and second sections respectively. Such an arrangement provides the unexpected and unpredictable advantage of using the multi-functional gaming assembly to play the games of baseball, basketball, tether-ball, tennis, badminton, volleyball and even as a stationary football target.

The portable free-standing first section may include a mobile primary base which may include a wire frame preferably having a handle and a plurality of rings extending out from a perimeter of the mobile primary base. A rear axle may be attached to the wire frame such that a pair of wheels may be rotatably connected to the rear axle. A cover may be removably positioned over the wire frame and may be adapted to be selectively weighed down with an existing filler material. A primary pole may be connected to the wire frame. The primary pole may further include at least two primary pole base sections attached to the wire frame. The primary pole base section may extend upwardly and orthogonally from the cover and preferably has a base slot formed therein. A primary pole first section may be removably connected to the primary pole base section and may be axially aligned with the primary pole base section. The primary pole first section preferably has a first slot formed therein. A primary pole second section may be removably connected to the primary pole first section and may be axially aligned therewith. A primary pole third section may further be removably connected to the primary pole second section and may be axially aligned therewith. Such an arrangement provides the unexpected and unpredictable advantage of detachably adapting the portable free-standing first section for a plurality of heights that games with a single pole may require such as basketball, baseball batting or tether-ball swinging game. For example, a baseball batting game may require just a primary pole first section while a basketball game may require all three primary pole sections to be erected to play the games. The filler material may further provide a stable and weighted mobile primary base to ensure that the assembly will not be knocked down by a user's ball.

The baseball batting game may include a non-linear shaft removably connected to the base slot and the first slot respectively. A baseball-holding member may be attached to an upper most end of the non-linear shaft. In this way, the baseball-holding member may be adapted to receive and support a baseball at an elevated position spaced from the primary pole first section. The basketball shooting game may include a back board preferably having a basketball hoop pivotally connected thereto.

The backboard may be removably coupled to the primary pole third section and thereby be simultaneously supported directly above the non-linear shaft during game-playing conditions. The tether-ball swinging game may include an end cap fitted on a top end of the primary pole third section. An eyelet may be coupled to the end cap. A flexible rope may be anchored to the eyelet. A ball may be tethered to the flexible rope. The flexible rope may further be suitably sized to swing the ball about the primary pole base, first, second and third sections respectively. Such an arrangement provides the unexpected and unpredictable advantage of adapting the assembly to be used for a number of games by simply using the designated parts as explained to install for example a baseball batting game, a basketball shooting game or a tether-ball swinging game easily and quickly. For example, the backboard may also be used as a stationary football target for practice sessions by football players.

The portable free-standing second section may include a mobile auxiliary base spaced apart from the mobile primary base. The portable free-standing second section may further include an auxiliary pole with an auxiliary pole base section statically mated to the mobile auxiliary base. An auxiliary pole first section may be removably connected to the auxiliary pole base section such that the auxiliary pole first section may be axially aligned with the auxiliary pole base section and may further be axially aligned therewith. An auxiliary pole second section may be removably connected to the auxiliary pole first section and may be axially aligned therewith.

An auxiliary pole third section may further be removably connected to the auxiliary pole second section and may be axially aligned therewith. The portable free-standing second section may further include a net removably attached to at least one of the auxiliary pole first, second and third sections respectively. In this way, for the tennis playing game, the net may be simultaneously coupled to the primary and auxiliary pole first sections respectively. For the badminton playing game, the net may be simultaneously coupled to the primary and auxiliary pole second sections respectively. For the volleyball playing game, the net is simultaneously coupled to the primary and auxiliary pole third sections respectively. Such an arrangement provides the unexpected and unpredictable advantage of adapting the assembly for playing net games requiring at least one pole section to hold a net between them. In this way, the assembly may be used to play games such as tennis, badminton and volleyball.

The invention may include a method of utilizing a multi-functional gaming assembly for allowing a player to participate in a variety of alternate games. Such a method may include the chronological steps of: providing a portable free-standing first section; selectively modifying the portable free-standing first section in such a manner to provide a baseball batting game, a basketball shooting game, and a tether-ball swinging game; and providing and removably connecting a portable free-standing second section to the portable free-standing first section.

The method may further include the chronological steps of: providing for the portable free-standing first and second sections to cooperate with each other to provide a tennis playing game, a badminton playing game, and a volleyball playing game; and providing and removably attaching a plurality of anchor stakes to the portable free-standing first and second sections respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figures 1, 2, 3, 4:
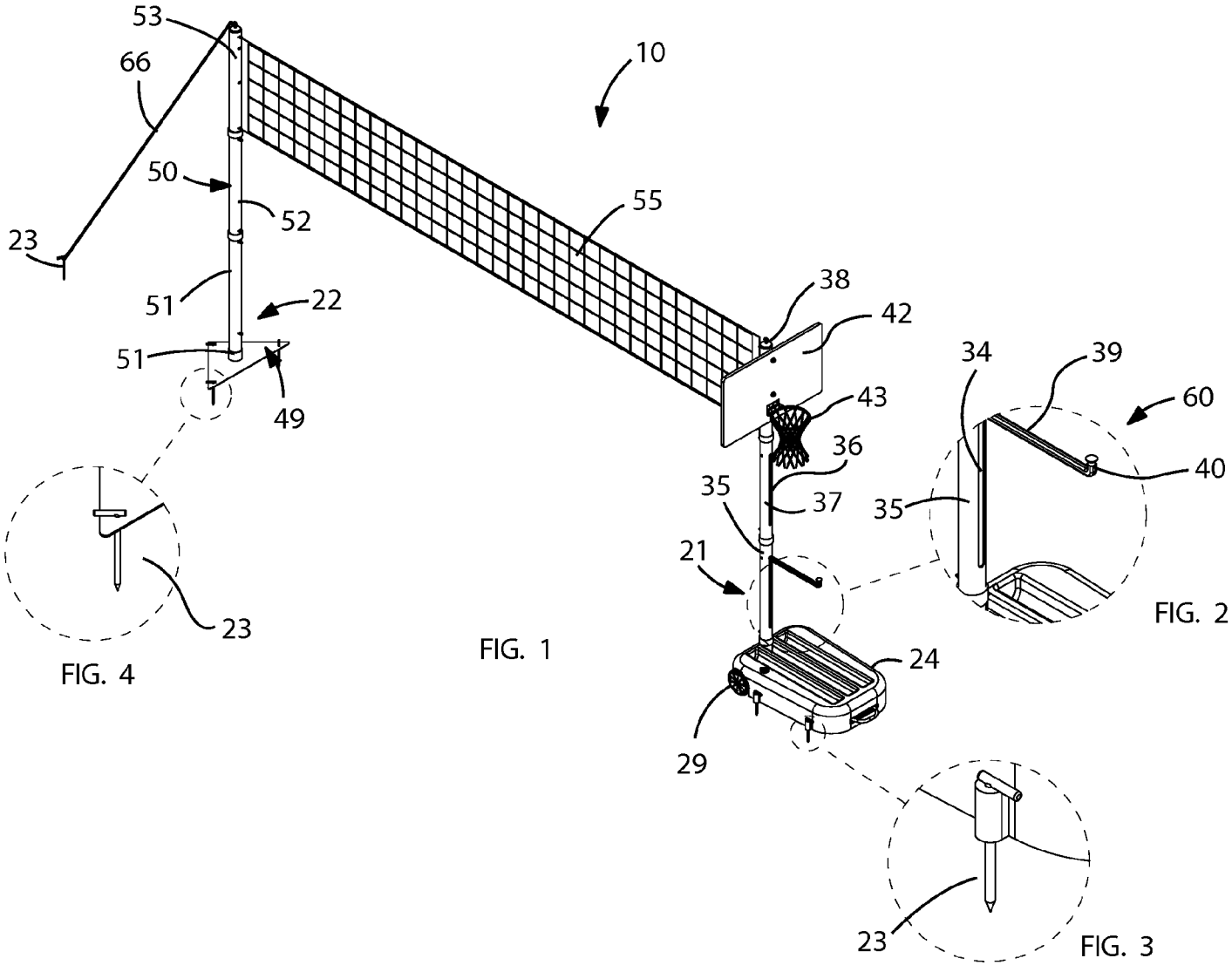
FIG. 1 is a perspective view showing a portable multi-functional gaming assembly configured in such a manner to include a baseball batting game, basketball playing game, and a volleyball playing game, in accordance with the present invention.
FIG. 2 is a detailed view of the non-linear shaft shown in FIG. 1.
FIG. 3 is a detailed view of the anchor stakes mounted on the mobile primary base shown in FIG. 1.
FIG. 4 is a detailed view of the anchor stakes mounted on the mobile auxiliary base shown in FIG. 1.
Figure 5:
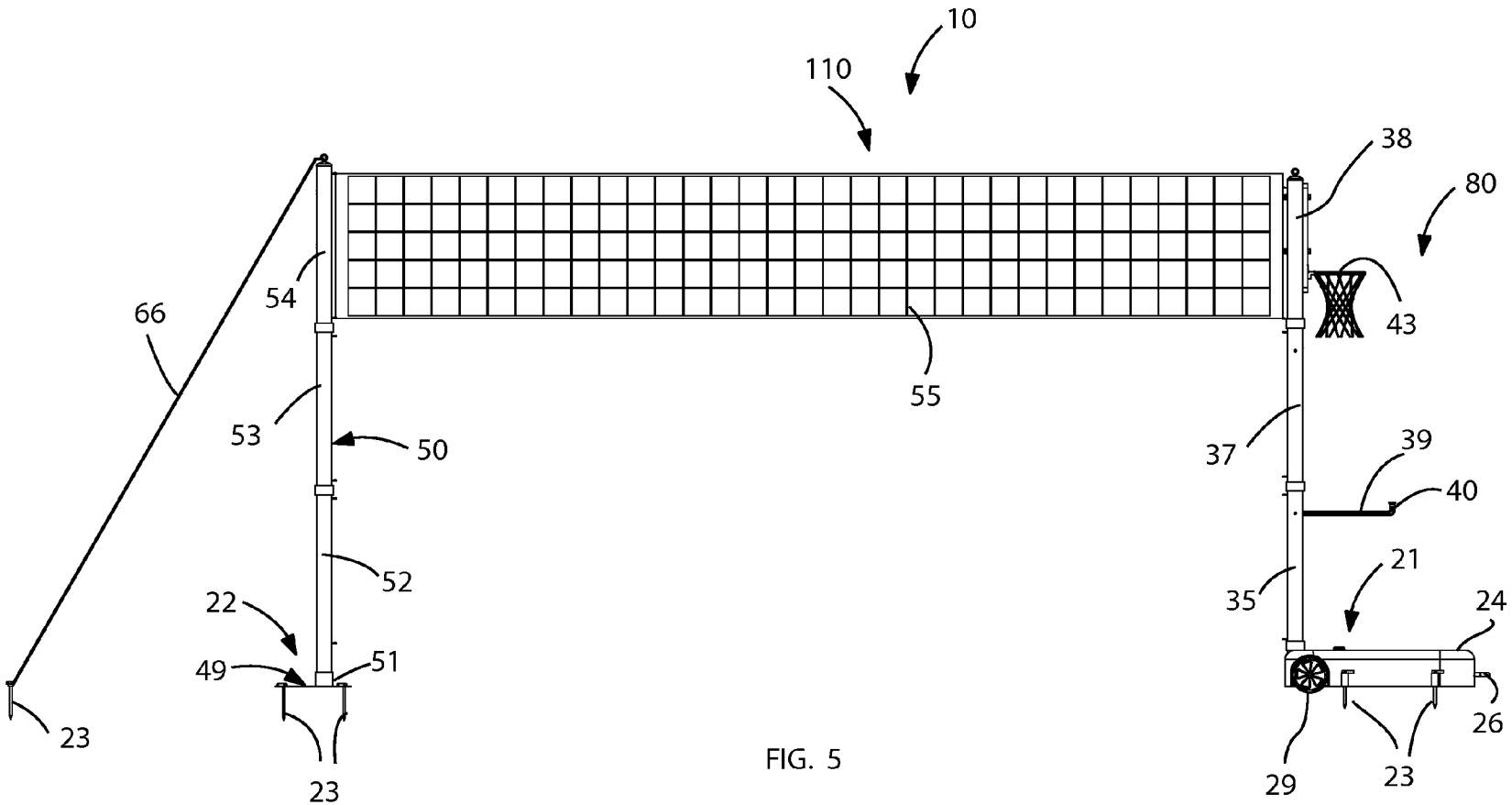
FIG. 5 is a side elevational view of the gaming assembly shown in FIG. 1 wherein a tether-ball swinging game is attached to the portable free-standing first section.
Figure 6:
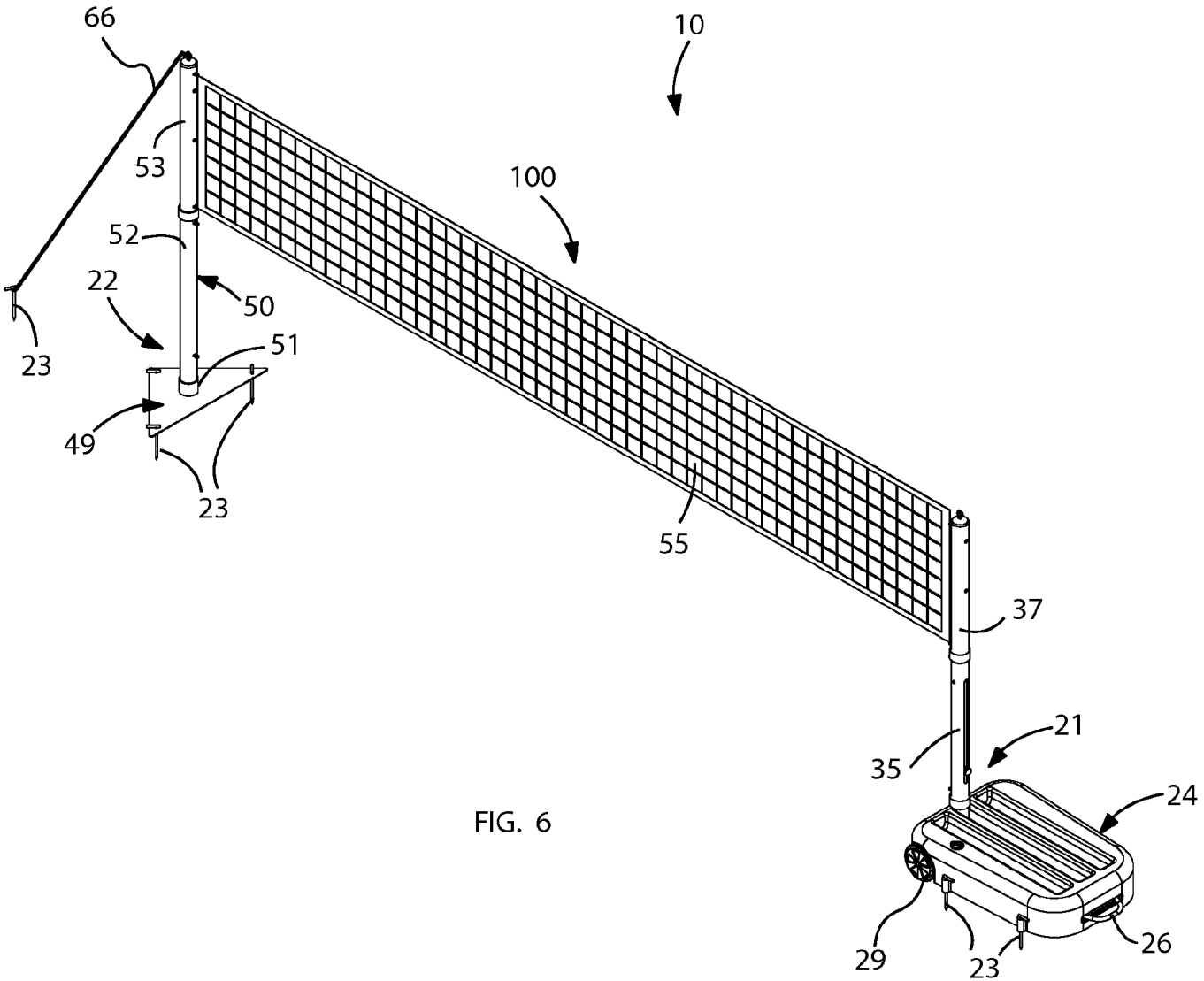
FIG. 6 is a perspective view of the gaming assembly configured for a badminton playing game.
Figure 7:
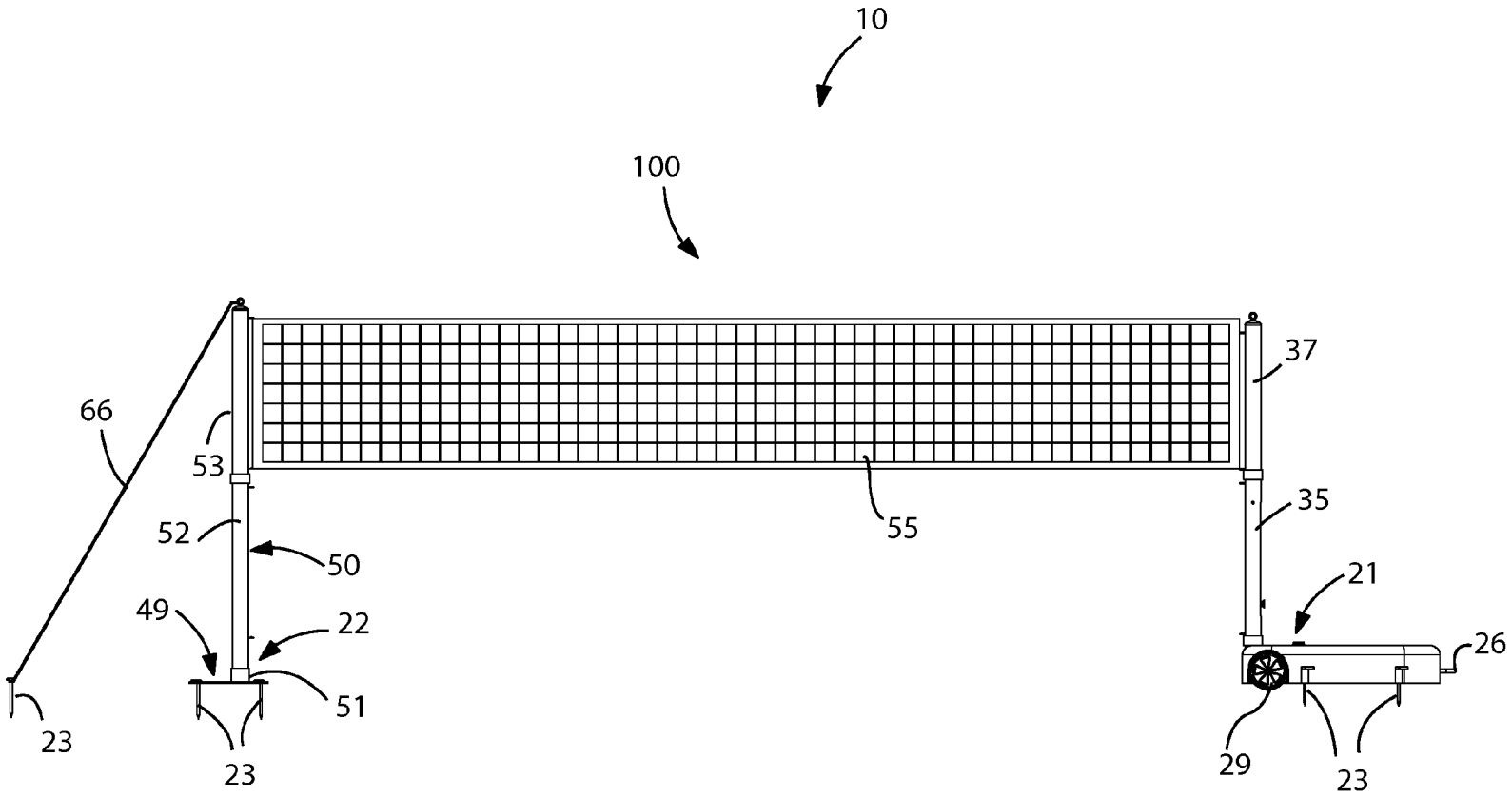
FIG. 7 is a side elevational view of the gaming assembly shown in FIG. 6.
Figure 8:
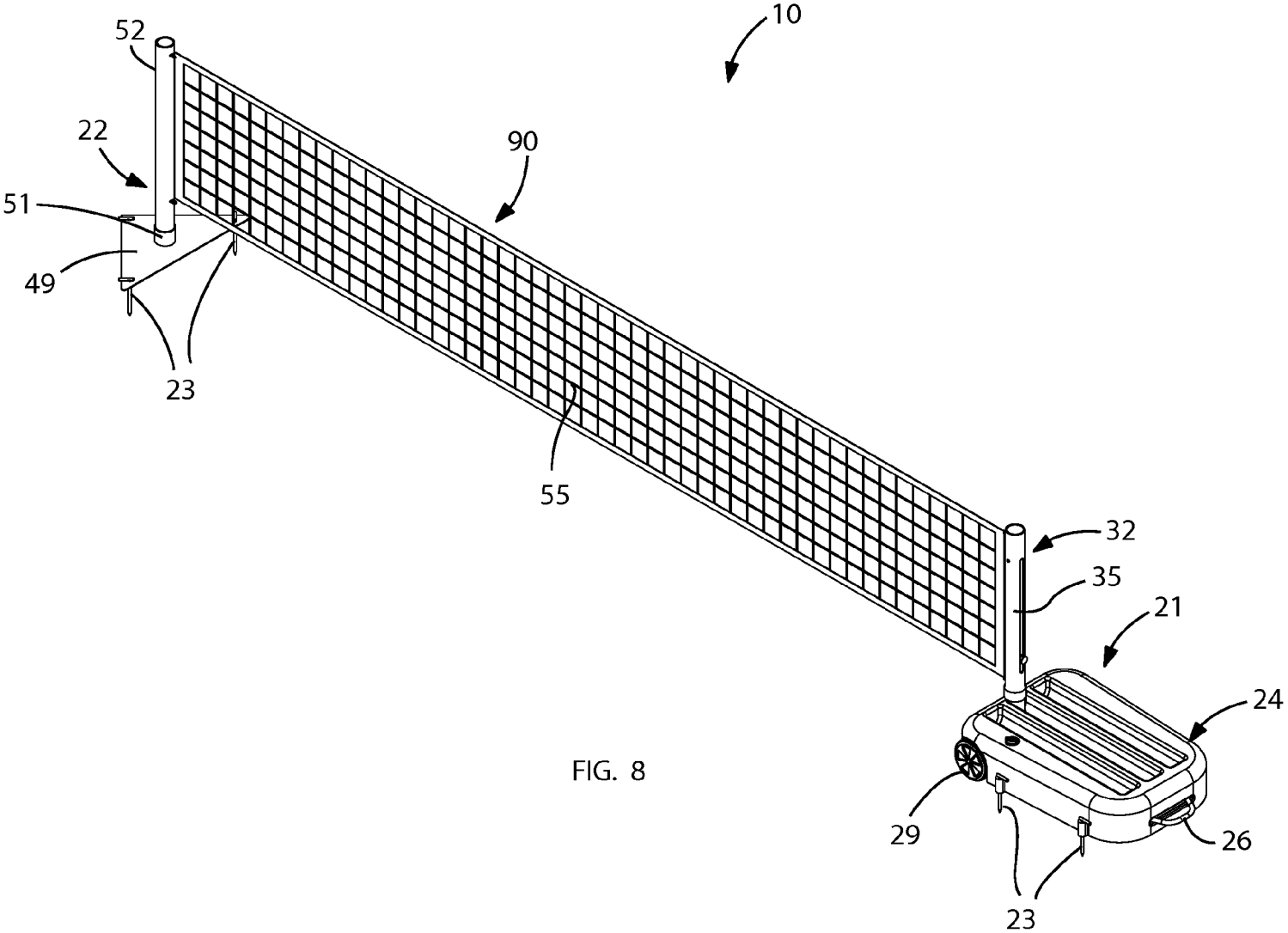
FIG. 8 is a perspective view of the gaming assembly configured for a tennis playing game.
Figure 10:
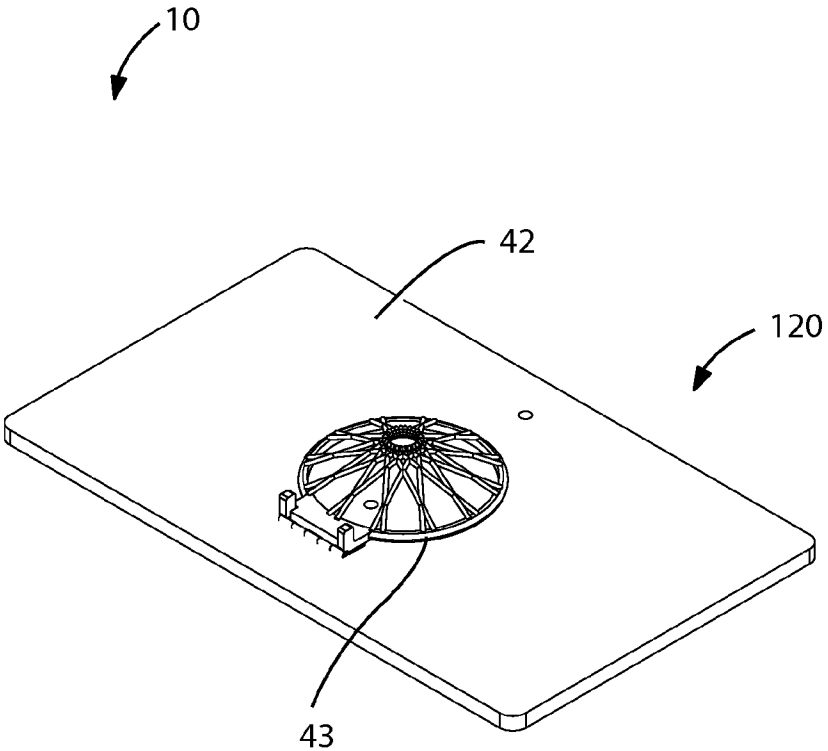
FIG. 10 is a perspective view of the hoop folded against the backboard for use as a stationary football target.
Figure 9:
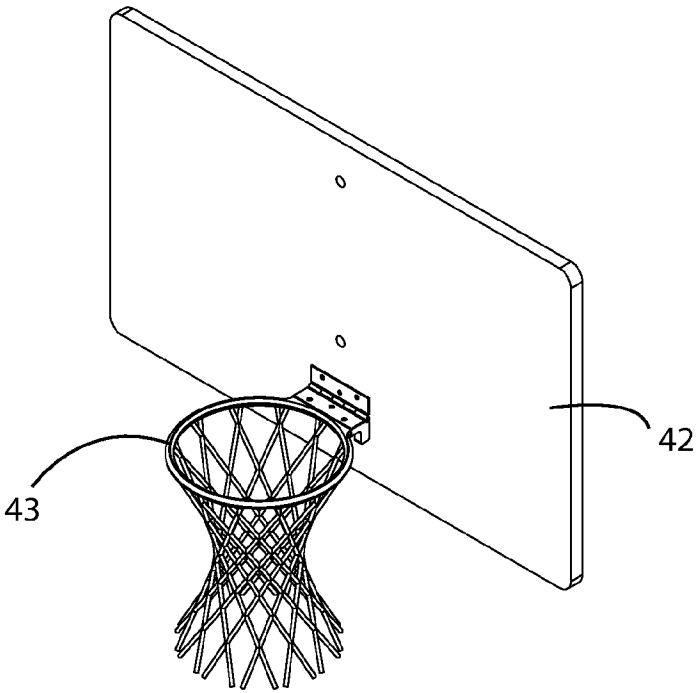
FIG. 9 is a perspective view of the backboard and hoop configured for a basketball shooting game.
Figure 11:
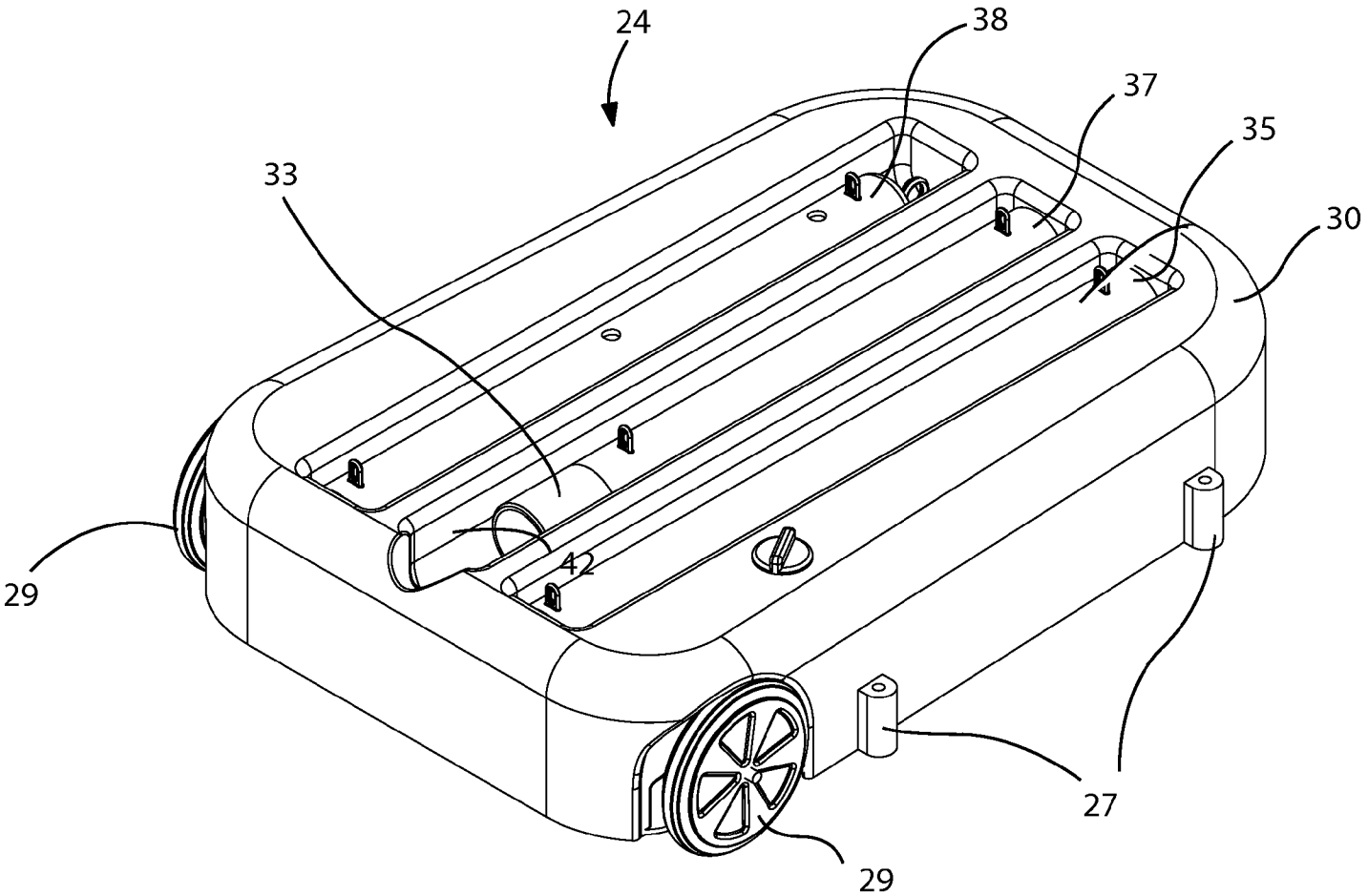
FIG. 11 is a perspective view of the mobile primary base.
Figure 12:
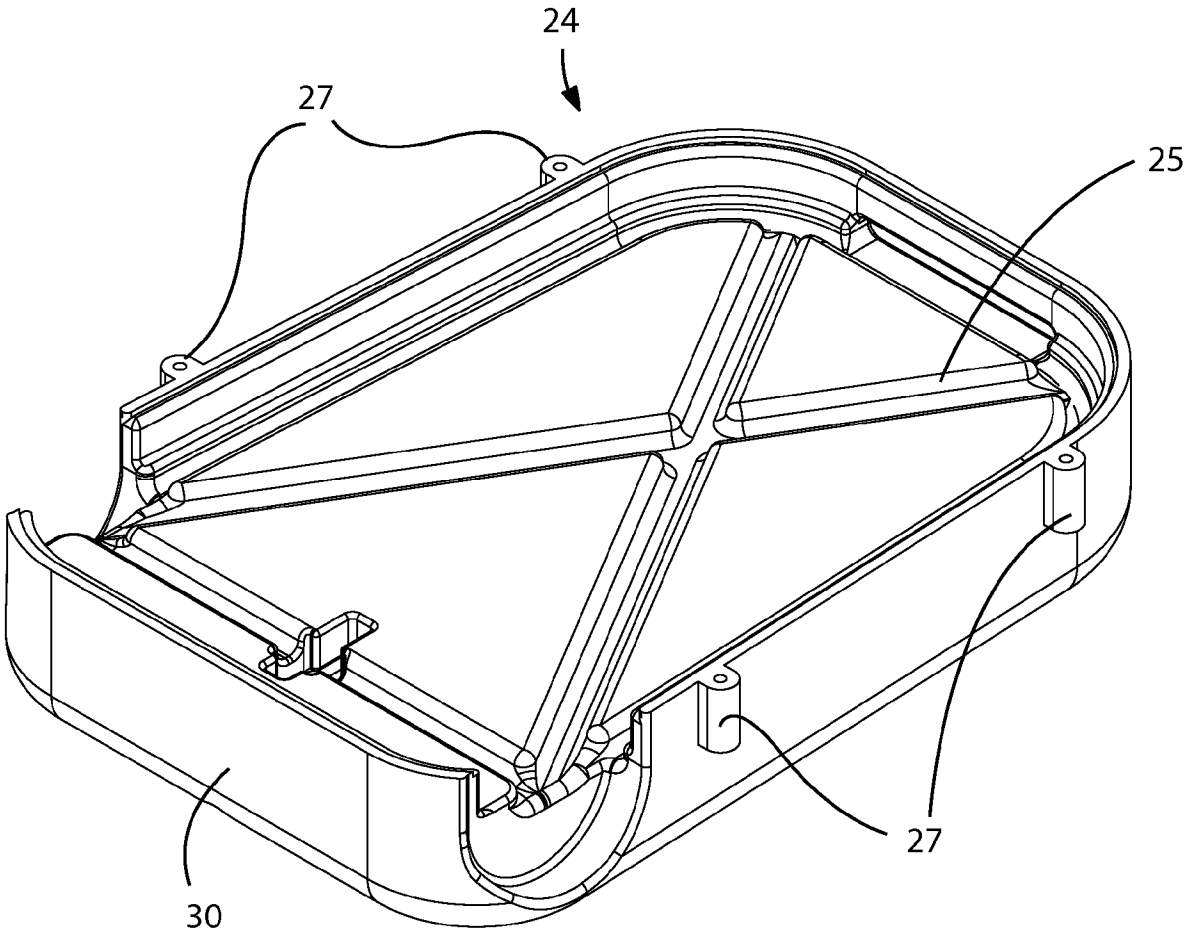
FIG. 12 is a perspective view of the mobile primary base in an inverted position.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The assembly of this invention is referred to generally in FIGS. 1-18 and is intended to provide a portable multifunctional gaming assembly. It should be understood that the present invention may be used to provide users with a means to easily construct a sports net in different locations for playing a court game, and the like, but should not be limited to the uses described herein.

Referring to FIGS. 1-18 in general, the multi-functional gaming assembly 10 may include a portable free-standing first section 21 capable of being selectively modified into at least two of a baseball batting game 60, a basketball shooting game 70, and a tether-ball swinging game 80 assemblies, respectively. A portable free-standing second section 22 may be removably connected to the portable free-standing first section 21 in such a manner that the portable free-standing first and second sections 21, 22 may cooperate to selectively include at least one of a tennis playing game 90, a badminton playing game 100 and a volleyball playing game 110. A plurality of anchor stakes 23 may be removably attached to the portable free-standing first and second sections 21, 22, respectively. Such an arrangement provides the unexpected and unpredictable advantage of using the multi-functional gaming assembly 10 to play a combination of games including baseball, basketball, tether-ball, tennis, badminton, volleyball and even as a stationary football target.

Figure 13:
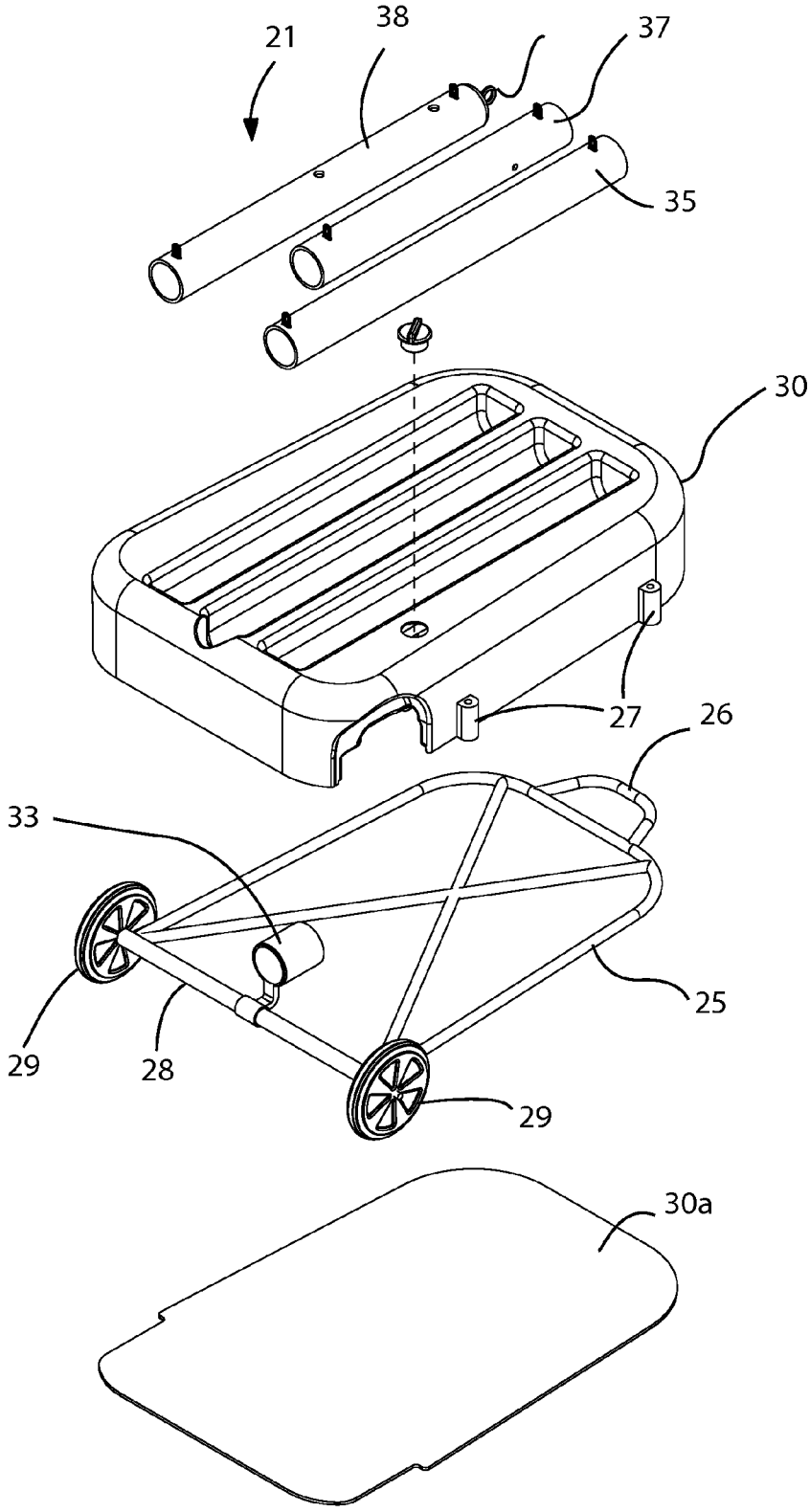
FIG. 13 is an exploded view of the portable free-standing first section wherein the primary pole sections are separated.
Figure 14:
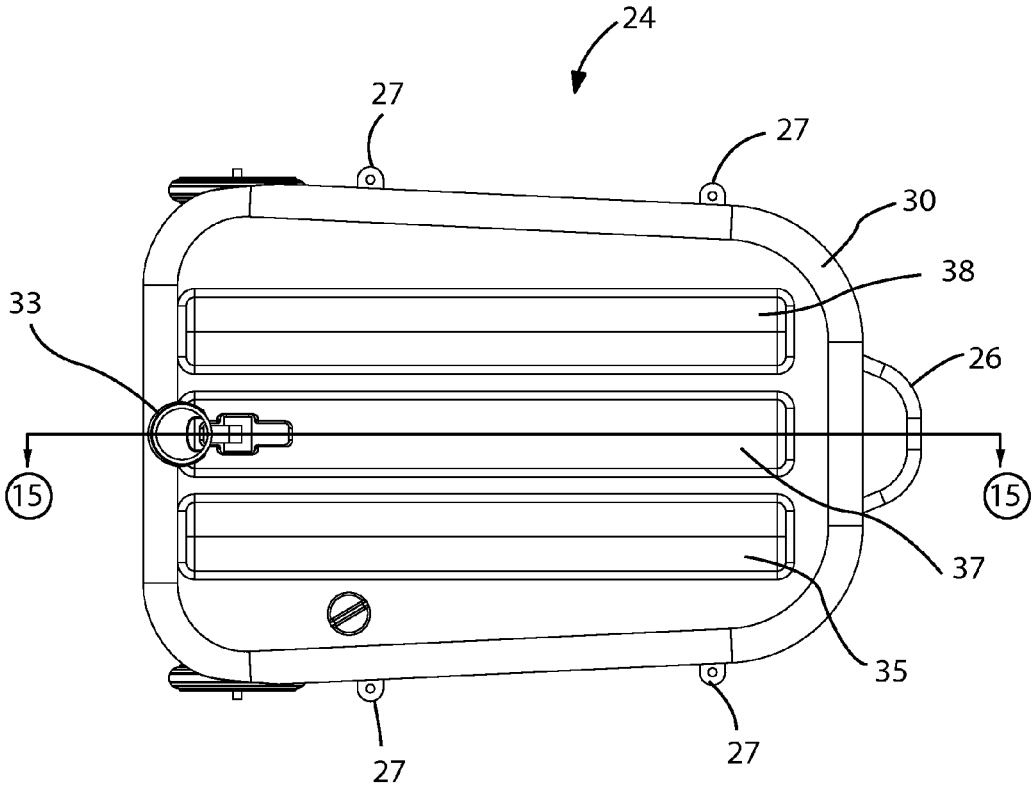
FIG. 14 is a top plan view of the portable free-standing first section shown in FIG. 13 wherein the primary pole sections are housed within the cover.
Figure 15:
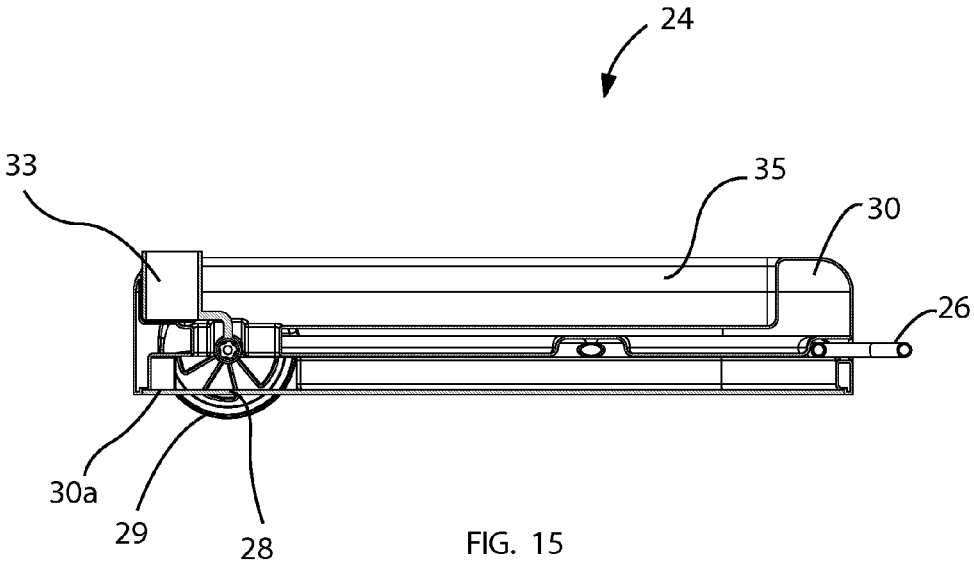
FIG. 15 is a cross-sectional view taken along line 15-15 of the free-standing first section shown in FIG. 14.

Referring to FIGS. 1, 6, 8 and 12-17, the portable free-standing first section 21 may include a mobile primary base 24 which may include a wire frame 25 (see FIGS. 12 and 13) preferably having a handle 26 (FIG. 13) and a plurality of rings 27 extending out from a perimeter of wire frame 25. Referring to FIGS. 13 and 15, a rear axle 28 may be attached to the wire frame 25 such that a pair of wheels 29 may be rotatably connected to the rear axle 28. A cover 30 and a bottom plate **30*a* may be removably positioned over and under the wire frame 25 in such a manner that a plurality of storage compartments are formed therebetween. The cover 30 may be adapted to be selectively weighed down with an existing filler material such as water or sand, for example. The filler material may further provide a stable and weighted mobile primary base 24 to ensure that assembly 10** will not be knocked down by a user's ball.

Figure 17:
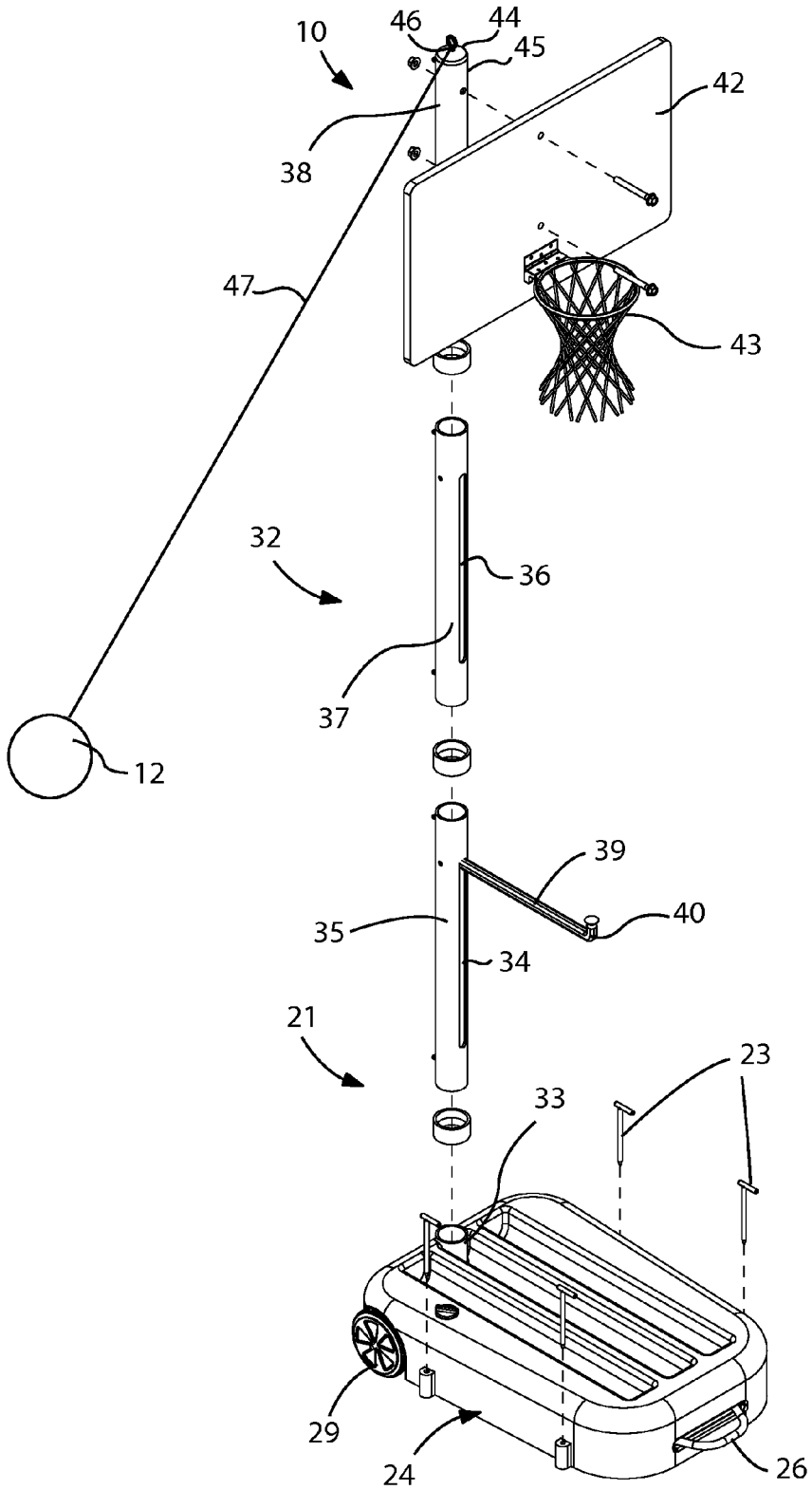
FIG. 17 is an exploded view of the gaming assembly shown in FIG. 16.
Figure 18:
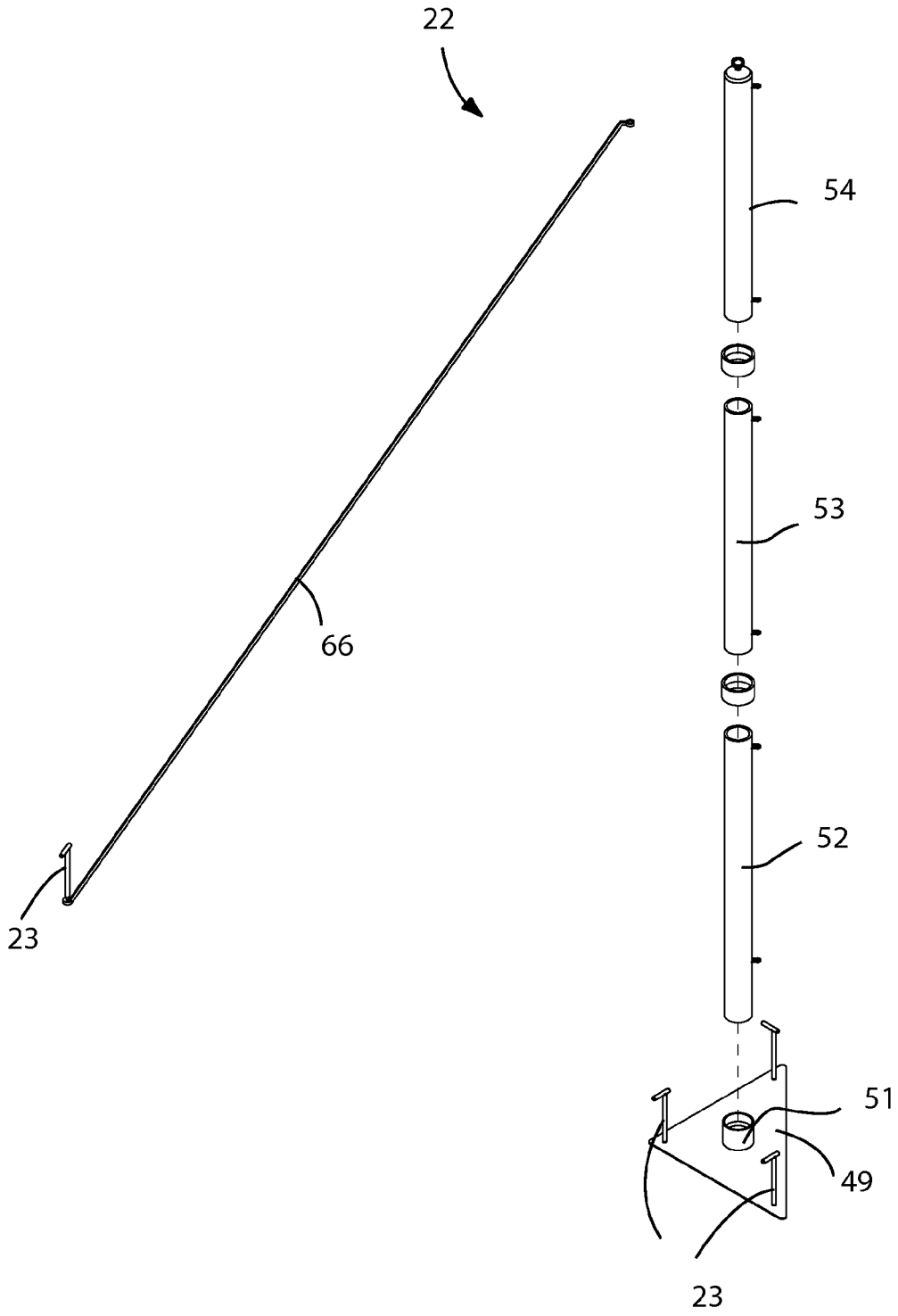
FIG. 18 is an exploded view of the portable free-standing second section.

Referring to FIG. 17, a primary pole 32 may be connected to the wire frame 25. The primary pole 32 may include at least two separate pole sections. One section may include a primary pole base section 33 attached to the wire frame 25. The primary pole base section 33 may extend upwardly and orthogonally from the cover 30 and preferably has a base slot 34 formed therein. Another section may include a primary pole first section 35 that may be removably connected to the primary pole base section 33 and may be axially aligned with the primary pole base section 33. The primary pole first section 35 preferably has a first slot 36 formed therein. Another section may include a primary pole second section 37 may be removably connected to the primary pole first section 35 and may be axially aligned therewith. Another section may include a primary pole third section 38 that may be removably connected to the primary pole second section 37 and may be axially aligned therewith.

Such an arrangement of primary pole sections provides the unexpected and unpredictable advantage of detachably adjusting the portable free-standing first section 21 between a variety of heights for various games such as basketball game 70, baseball batting game 60 or tether-ball swinging game 80. For example, a baseball batting game 60 may require just a primary pole first section 35 while a basketball game 70 may require all three primary pole sections 35, 37, 38 to be erected to play the games as shown in FIGS. 1, 2, 5, 16 and 17.

Referring to FIGS. 1, 2, 5, 16 and 17, the baseball batting game 60 may include a non-linear shaft 39 removably connected to the first slot 34 and the second slot 36, respectively. A baseball-holding member 40 may be attached to an upper most end 41 of the non-linear shaft 39. In this way, the baseball-holding member 40 may be adapted to receive and support a baseball 11 (FIG. 16) at an elevated position spaced from the primary pole first section 35. The basketball shooting game 70 may include a back board 42 preferably having a basketball hoop 43 pivotally connected thereto. The backboard 42 may be removably coupled to the primary pole third section 38 and thereby be simultaneously supported directly above the non-linear shaft 39 during game-playing conditions. Such a combined structural configuration provides the unpredicted and unexpected advantage of permitting the user to simultaneously enjoy both the basketball game 70 and baseball batting game 60.

Figure 16:
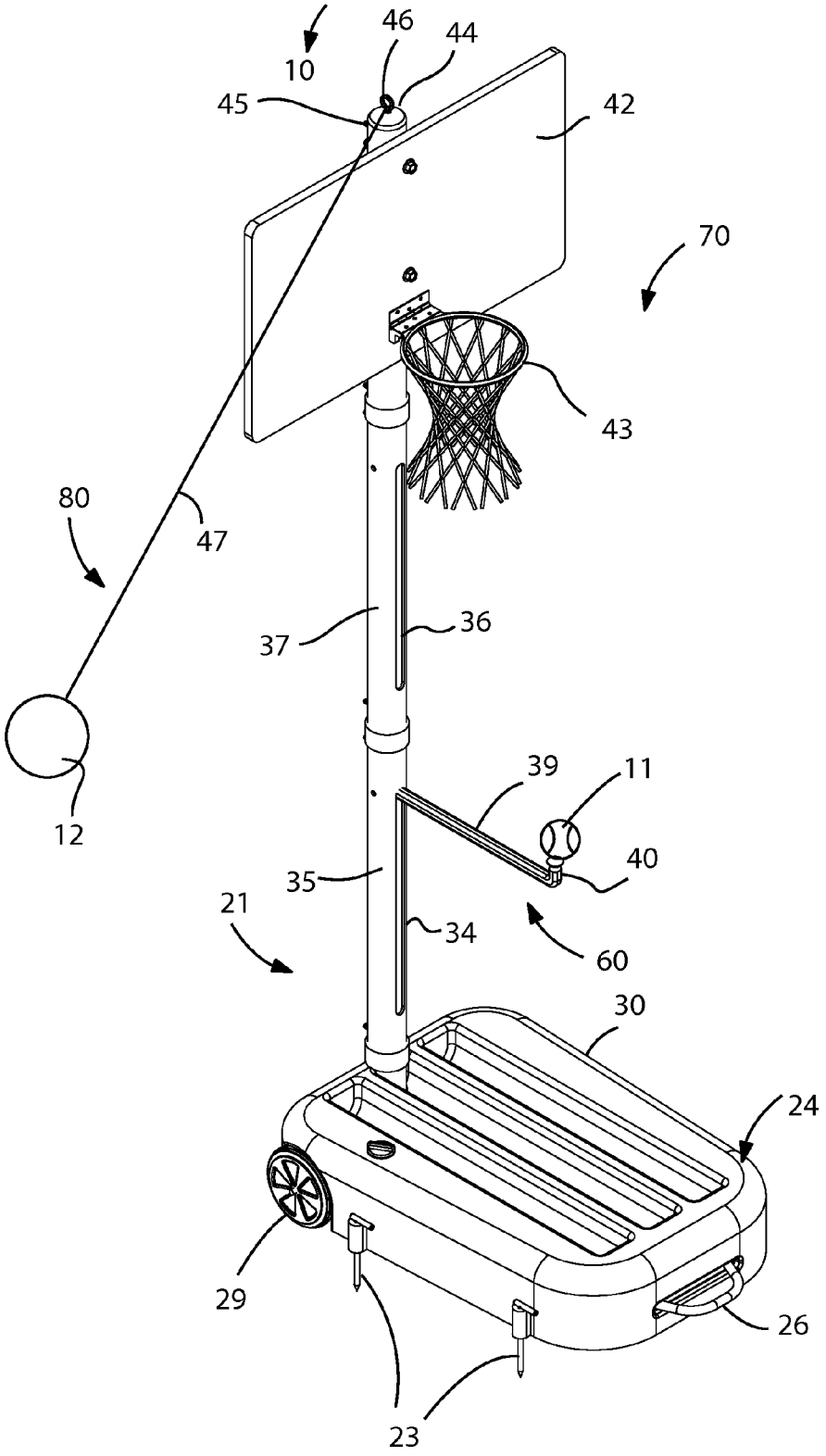
FIG. 16 is a perspective view of the gaming assembly configured for simultaneously playing a baseball bating game, basketball shooting game and a tetherball swinging game.

Referring to FIGS. 16 and 17, the tether-ball swinging game 80 may include an end cap 44 fitted on a top end 45 of the primary pole third section 38. An eyelet 46 may be coupled to the end cap 44. A flexible rope 47 may be anchored to the eyelet 46 and a ball 12 may be tethered to the flexible rope 47. The flexible rope 47 may be suitably sized to swing the ball 12 about the primary pole base, first, second and third sections 33, 35, 37, 38, respectively. Such an arrangement provides the unexpected and unpredictable advantage of adapting the assembly 10 to be used for a number of different games by simply configuring and reconfiguring the above-mentioned parts to form a baseball batting game 60, a basketball shooting game 70 and a tether-ball swinging game 80 easily and quickly. For example, the backboard 42 may also be used as a stationary football target 120 for practice sessions (FIG. 10) by football players.

Referring to FIGS. 1, 4-8 and 18, the portable free-standing second section 22 may include a mobile auxiliary base 49 spaced apart from the mobile primary base 24. The portable free-standing second section 22 may further include an auxiliary pole 50 including at least two auxiliary pole sections. For example, one auxiliary section may include an auxiliary pole base section 51 statically mated to the mobile auxiliary base 49. Another auxiliary section may include an auxiliary pole first section 52 removably connected to the auxiliary pole base section 51 such that the auxiliary pole first section 52 may be axially aligned with the auxiliary pole base section 51. Another auxiliary section may include an auxiliary pole second section 53 that may be removably connected to the auxiliary pole first section 52 and may be axially aligned therewith. Another auxiliary section may include an auxiliary pole third section 54 that may further be removably connected to the auxiliary pole second section 53 and may be axially aligned therewith.

Referring to FIGS. 1 and 5-8, the portable free-standing second section 22 may further include a net 55 removably attached to at least one of the auxiliary pole first, second and third sections 52, 53, 54, respectively. In this way, for the tennis playing game 90, the net 55 may be simultaneously coupled to the primary and auxiliary pole first sections 35, 52, respectively. For the badminton playing game 100, the net 55 may be simultaneously coupled to the primary and auxiliary pole second sections 37, 53, respectively. For the volleyball playing game 110, the net 55 is simultaneously coupled to the primary and auxiliary pole third sections 38, 54, respectively. Such an arrangement provides the unexpected and unpredictable advantage of adapting the multi-functional gaming assembly between alternate games requiring primary and secondary poles 32, 50 to hold a net 55 therebetween at alternate heights.

Referring to FIGS. 1, 5-6 and 18, an anchor line 66 may also be employed to maintain auxiliary pole 50 at a substantially stable position when the next is impacted with an external force. Such a combined structural configuration provides the unexpected and unpredictable advantage of minimizes requisite parts to separately configure each of the aforementioned games. Furthermore, the weight of the first portable free-standing section 21 counter balances the combined weight of the second portable free-standing section 22 and anchor line 66, thereby enabling a user to continuously employ the present invention during extended periods of time while reducing the risk of prematurely and undesirability toppling the net over as is often found with conventional prior art assemblies.

In an alternative embodiment, the assembly 10 may feature a vinyl sheet that could be clipped into place over net 55. The vinyl sheet may have the approximate dimensions of a hockey net. The vinyl sheet may be painted with the shape of a hockey goalie in it. The vinyl sheet may be a solid piece with cutouts in the positions of the hockey net that would typically be exposed because the goalie cannot cover them. For example, the areas over the goalie's shoulders, the area immediately to either side of the goalie, and a space between the goalie's legs may be left open to simulate the areas of the net the player could score in, in actual game play. This embodiment would allow the user to practice their street hockey skills but giving them a target to shoot.

The present invention may further include a method of utilizing a multi-functional gaming assembly 10 for allowing a player to participate in a variety of alternate games. Such a method may include the chronological steps of: providing a portable free-standing first section 21; and selectively modifying the portable free-standing first section 21 in such a manner to provide a baseball batting game 60, a basketball shooting game 70, and a tether-ball swinging game 80.

The method may further include the chronological steps of: providing and removably connecting a portable free-standing second section 22 to the portable free-standing first section 21; causing the portable free-standing first and second sections 21, 22 to cooperate with each other in such a manner to provide a tennis playing game 90, a badminton playing game 100, and a volleyball playing game 110; and providing and removably attaching a plurality of anchor stakes 23 to the portable free-standing first and second sections 21, 22, respectively. The combination of such claimed elements provides an unpredictable and unexpected benefit of providing a portable multi-functional and transformable sports assembly, which solves the problem of having to individually provide bulky, expensive and non-portable sports equipment for these games.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A multi-functional gaming assembly for allowing a player to participate in a variety of alternate games, said multi-functional gaming assembly comprising:

a portable free-standing first section configured in such a manner that said portable free-standing first section is capable of being selectively modified to selectively comprise at least two of a baseball batting game, a basketball shooting game, and
a tether-ball swinging game; and
a portable free-standing second section removably connected to said portable free-standing first section in such a manner that said portable free-standing first and second sections cooperate to selectively comprise at least one of
a tennis playing game,
a badminton playing game, and
a volleyball playing game;
wherein said portable free-standing first section comprises
a mobile primary base comprising
a wire frame having a handle and a plurality of rings extending out from a perimeter of said wire frame respectively,
a rear axle attached to said wire frame,
a pair of wheels rotatably connected to said rear axle, and
a cover removably positioned over said wire frame, said cover being adapted to be selectively weighed down with an existing filler material; and
a primary pole connected to said wire frame, said primary pole comprising at least two of
a primary pole base section attached to said wire frame, said primary pole base section extending upwardly and orthogonally from said cover,
a primary pole first section removably connected to said primary pole base section, said primary pole first section being axially aligned with said primary pole base section, said primary pole first section having a first slot formed therein,
a primary pole second section removably connected to said primary pole first section and being axially aligned therewith, said primary pole second section having a second slot formed therein, and
a primary pole third section removably connected to said primary pole second section and being axially aligned therewith.

2. The multi-functional gaming assembly of claim 1, wherein said baseball batting game comprises:
a non-linear shaft removably connected to said first slot; and
a baseball-holding member attached to an upper most end of said non-linear shaft;
wherein said baseball-holding member is adapted to receive and support a baseball at an elevated position spaced from said primary pole first section.

3. The multi-functional gaming assembly of claim 2, wherein said basketball shooting game comprises: a back board having a basketball hoop pivotally connected thereto, said backboard being removably coupled to said primary pole third section and thereby being simultaneously supported directly above said non-linear shaft during game-playing conditions.

4. The multi-functional gaming assembly of claim 1, wherein said tether-ball swinging game comprises:
an end cap fitted on a top end of said primary pole third section;
an eyelet coupled to said end cap;
a flexible rope anchored to said eyelet; and
a ball tethered to said flexible rope;
wherein said flexible rope is suitably sized to swing said ball about said primary pole base, first, second and third sections respectively.

5. The multi-functional gaming assembly of claim 1, wherein said portable free-standing second section comprises:
a mobile auxiliary base spaced apart from said mobile primary base;
an auxiliary pole comprising at least two of
an auxiliary pole base section statically mated to said mobile auxiliary base,
an auxiliary pole first section removably connected to said auxiliary pole base section, said auxiliary pole first section being axially aligned with said auxiliary pole base section and being axially aligned therewith,
an auxiliary pole second section removably connected to said auxiliary pole first section and being axially aligned therewith, and
an auxiliary pole third section removably connected to said auxiliary pole second section and being axially aligned therewith; and
a net removably attached to at least one of said auxiliary pole first, second and third sections.

6. The multi-functional gaming assembly of claim 5, wherein, for said tennis playing game, said net is simultaneously coupled to said primary and auxiliary pole first sections respectively.

7. The multi-functional gaming assembly of claim 5, wherein, for said badminton playing game, said net is simultaneously coupled to said primary and auxiliary pole second sections respectively.

8. The multi-functional gaming assembly of claim 5, wherein, for said volleyball playing game, said net is simultaneously coupled to said primary and auxiliary pole third sections respectively.

9. A multi-functional gaming assembly for allowing a player to participate in a variety of alternate games, said multi-functional gaming assembly comprising:
a portable free-standing first section configured in such a manner that said portable free-standing first section is capable of being selectively modified to selectively comprise at least two of
a baseball batting game,
a basketball shooting game, and
a tether-ball swinging game;
a portable free-standing second section removably connected to said portable free-standing first section in such a manner that said portable free-standing first and second sections cooperate to selectively comprise at least one of
a tennis playing game,
a badminton playing game, and
a volleyball playing game; and
a plurality of anchor stakes removably attached to said portable free-standing first and second sections respectively;
wherein said portable free-standing first section comprises
a mobile primary base comprising
a wire frame having a handle and a plurality of rings extending out from a perimeter of said wire frame respectively,
a rear axle attached to said wire frame,
a pair of wheels rotatably connected to said rear axle, and
a cover removably positioned over said wire frame, said cover being adapted to be selectively weighed down with an existing filler material; and
a primary pole connected to said wire frame, said primary pole comprising at least two of
a primary pole base section attached to said wire frame, said primary pole base section extending upwardly and orthogonally from said cover, a primary pole first section removably connected to said primary pole base section, said primary pole first section being axially aligned with said primary pole base section, said primary pole first section having a first slot formed therein, a primary pole second section removably connected to said primary pole first section and being axially aligned therewith, said primary pole second section having a second slot formed therein, and a primary pole third section removably connected to said primary pole second section and being axially aligned therewith.

10. The multi-functional gaming assembly of claim 9, wherein said baseball batting game comprises:

a non-linear shaft removably connected to said first slot; and a baseball-holding member attached to an upper most end of said non-linear shaft;

wherein said baseball-holding member is adapted to receive and support a baseball at an elevated position spaced from said primary pole first section.

11. The multi-functional gaming assembly of claim 10, wherein said basketball shooting game comprises: a back board having a basketball hoop pivotally connected thereto, said backboard being removably coupled to said primary pole third section and thereby being simultaneously supported directly above said non-linear shaft during game-playing conditions.

12. The multi-functional gaming assembly of claim 9, wherein said tether-ball swinging game comprises:

an end cap fitted on a top end of said primary pole third section;

an eyelet coupled to said end cap;

a flexible rope anchored to said eyelet; and a ball tethered to said flexible rope;

wherein said flexible rope is suitably sized to swing said ball about said primary pole base, first, second and third sections respectively.

13. The multi-functional gaming assembly of claim 9, wherein said portable free-standing second section comprises:

a mobile auxiliary base spaced apart from said mobile primary base;

an auxiliary pole comprising at least two of an auxiliary pole base section statically mated to said mobile auxiliary base, an auxiliary pole first section removably connected to said auxiliary pole base section, said auxiliary pole first section being axially aligned with said auxiliary pole base section and being axially aligned therewith, an auxiliary pole second section removably connected to said auxiliary pole first section and being axially aligned therewith, and an auxiliary pole third section removably connected to said auxiliary pole second section and being axially aligned therewith; and a net removably attached to at least one of said auxiliary pole first, second and third sections.

14. The multi-functional gaming assembly of claim 13, wherein, for said tennis playing game, said net is simultaneously coupled to said primary and auxiliary pole first sections respectively.

15. The multi-functional gaming assembly of claim 13, wherein, for said badminton playing game, said net is simultaneously coupled to said primary and auxiliary pole second sections respectively.

16. The multi-functional gaming assembly of claim 13, wherein, for said volleyball playing game, said net is simultaneously coupled to said primary and auxiliary pole third sections respectively.

* * * * *